United States Patent [19]

Kalar

[11] Patent Number: 5,025,818

[45] Date of Patent: Jun. 25, 1991

[54] PAINT PUMP CLEANING SYSTEM

[76] Inventor: David L. Kalar, Geneseo Rd., Paso Robles, Calif. 93446

[21] Appl. No.: 403,567

[22] Filed: Sep. 6, 1989

[51] Int. Cl.[5] ..... B08B 3/02

[52] U.S. Cl. ..... 134/170; 134/200; 134/104.4; 134/171; 118/302

[58] Field of Search ..... 134/171, 166 R, 104.4, 134/169 C, 170, 200, 168; 118/302; 239/109

[56] References Cited

U.S. PATENT DOCUMENTS

| | | | |
|---|---|---|---|
| 2,708,448 | 5/1955 | Reeve | 134/168 C |
| 2,745,418 | 5/1956 | Balcom et al. | 134/102 |
| 2,786,000 | 3/1957 | Roach | 134/170 X |
| 3,273,573 | 9/1966 | Southard | 134/104.4 |
| 3,670,744 | 6/1972 | Bender | 134/169 C |
| 3,963,438 | 6/1976 | Banez | 134/168 C |
| 4,025,363 | 5/1977 | De Santis | 134/200 X |
| 4,288,882 | 9/1981 | Takeuchi | 15/88 |
| 4,440,185 | 4/1984 | Wiltse | 134/104.4 |

*Primary Examiner*—Frankie L. Stinson
*Attorney, Agent, or Firm*—Daniel C. McKown

[57] ABSTRACT

Apparatus for removing residual paint from the inside and outside of an industrial paint spraying outfit includes a drum containing a spray manifold and a hose for connecting the output of the paint pump to the spray manifold. In use, a few gallons of solvent are placed in the drum, and the paint-bearing portions of the outfit are lowered into the drum. Thereafter, the pump is operated so as to circulate solvent through the pump, through the hose to the manifold, which sprays the solvent on the portions of the outfit that are in the drum. No separate solvent pump is needed; the paint pump is caused to spray solvent on itself. A splash ring is provided around the cover portion of the outfit to prevent liquid solvent from escaping the drum. The apparatus greatly reduces contamination of the atmosphere because only a small amount of solvent is needed, and it is confined during use to the drum. Accordingly, the cost of disposing the spent solvent is minimized.

5 Claims, 2 Drawing Sheets

FIG. 2
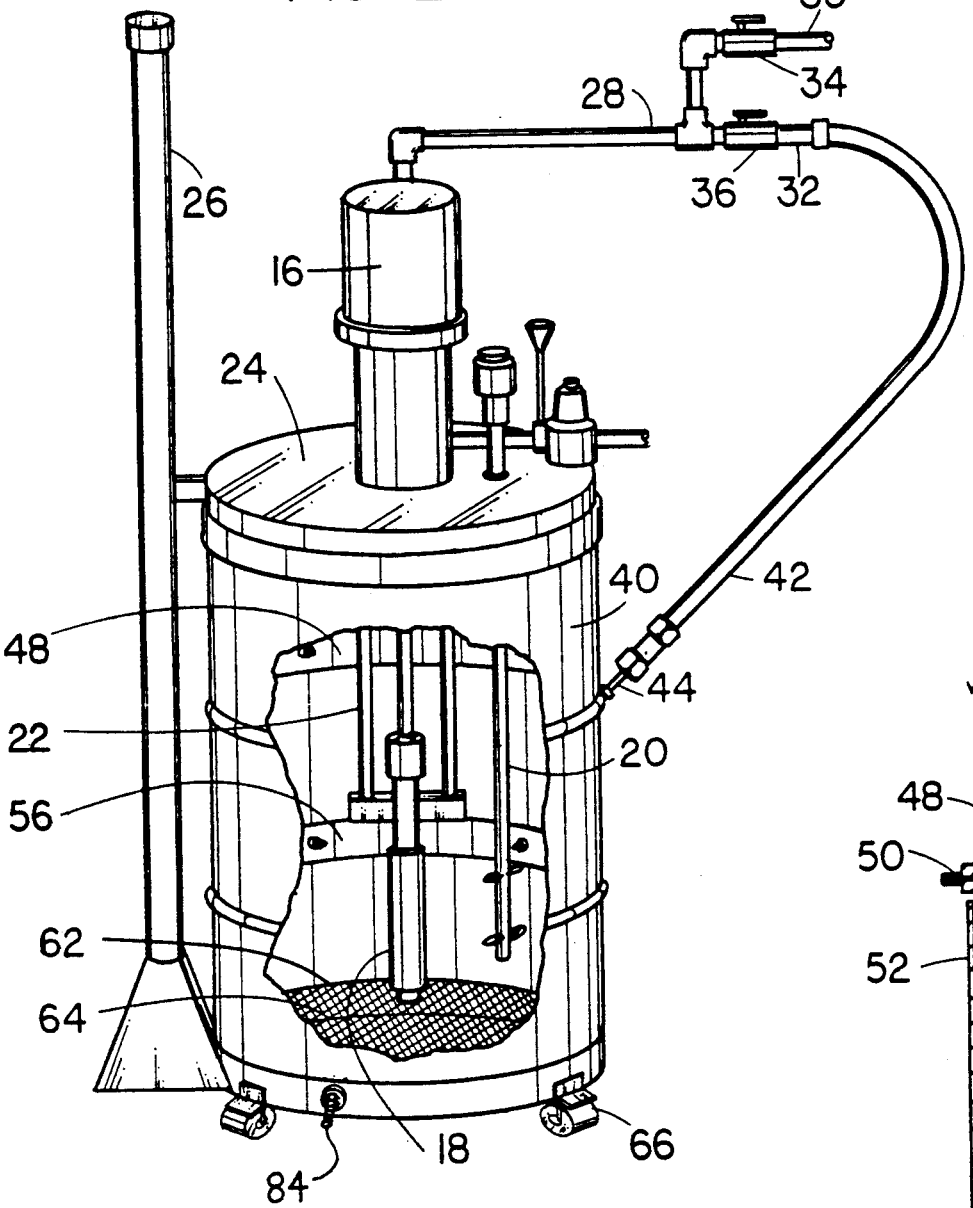
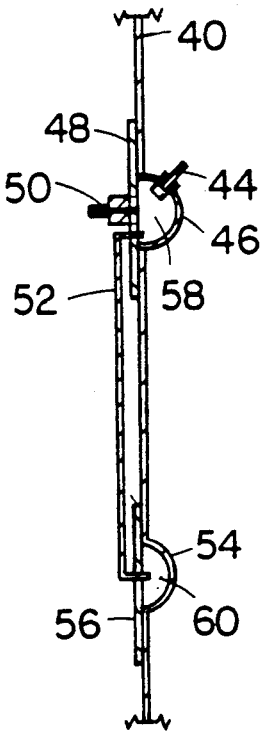
FIG. 3
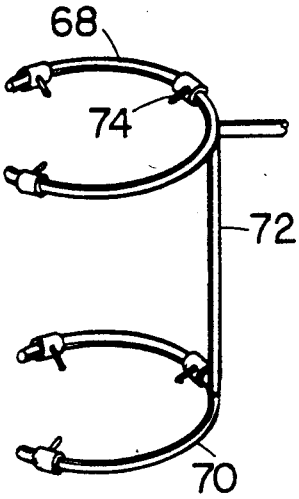
FIG. 4

PAINT PUMP CLEANING SYSTEM

BACKGROUND OF THE INVENTION

1. Field of the Invention

The present invention is in the field of industrial painting, and specifically relates to a method and apparatus for minimizing pollution of the environment when it is necessary to remove residual paint from the pump and associated equipment, for example, before using the pump with paint of a different color.

2. The Prior Art

A typical industrial airless paint spraying outfit is used to pump paint under pressure from a drum in which it is supplied, to a hand-held spray gun. The paint spraying outfit is mounted on a drum cover, with an air motor above the drum cover and with a pump and agitator mounted below the drum cover. When the paint spraying outfit is in use, the drum cover rests on the upper rim of the open paint drum with the pump and agitator extending into the drum. When a first drum of paint has been emptied, the paint spraying outfit is lifted vertically out of the drum, the carted drum is rolled away, and a fresh drum is substituted.

However, if no further painting is to be done, or if paint of a different color or type is to be used, a different problem arises; namely, the problem of removing the residual paint from the insides of the pump and the hoses, as well as from the outside of the pump, agitator, and other structures that in use extend into the drum of paint.

Although it is known that a small object, such as a hand-held spray gun, can be placed in an enclosure and sprayed with a solvent to remove residual paint from the exterior of the object, the task of removing the residual paint from the pump and agitator and related parts that extend into the paint drum has, apparently, not been addressed. Current practice appears to consist of wiping those parts with a solvent-soaked rag. Because the solvent is highly volatile, much of it evaporates, filling the room with fumes, or polluting the atmosphere if done outdoors. The solvent-soaked rags are a fire hazard, and must be handled appropriately. In the process of wiping down the parts that extend into the paint drum, the worker was exposed to the possibility of accidental contact with the solvent as well as the hazard of breathing the solvent fumes.

In recent years, there has been a growing public awareness of environmental issues and a growing concern over the use of toxic and hazardous chemicals in the workplace. Strict regulations are being enacted and procedures that were once considered appropriate are no longer acceptable in the current climate of environmental awareness.

SUMMARY OF THE INVENTION

Recognizing that existing techniques for cleaning residual paint from the pump and agitator of a paint spraying outfit were environmentally unacceptable, the present inventor devised an apparatus and method that minimizes the release of solvent fumes into the atmosphere and that uses less solvent than previous cleaning methods, thereby reducing the amount of solvent that needs to be disposed of.

In the present invention, the solvent can be recycled to a far greater extent than was possible in the earlier technique, resulting in not only a saving in the cost of the solvent, but also a considerable saving in the cost of disposing of the spent solvent.

In accordance with a preferred embodiment of the present invention, there is provided a drum having a spray manifold mounted within it. A relatively small amount of solvent is then placed in the drum, typically enough to fill the drum to a depth of several inches, and the paint spraying outfit is then lowered into the drum. The output hose from the pump, which normally is connected to a hand-held spray gun, is instead connected to the spray manifold. Pressurized air is then applied to the outfit to power the pump, which then pumps solvent through the pump and the output hose, and into the spray manifold, which sprays the solvent onto the outside of the pump, the agitator, and the structural members that extend into the drum, thereby removing the residual paint from those parts. During this operation, the drum remains closed and the solvent is confined within it. It is not necessary for the worker to come into direct contact with the solvent, and very little of the solvent evaporates while the outfit is being lowered into the drum and later lifted from the drum, which is then covered.

In accordance with the preferred embodiment of the invention, a splash ring is bolted to the part of the paint spraying outfit that serves as a cover for the drum. The purpose of the splash ring is to prevent the solvent from escaping between the drum cover portion of the paint spraying outfit and the drum.

The novel features which are believed to be characteristic of the invention, both as to organization and method operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 2 is a top front perspective view showing a preferred embodiment of the present invention in use;

FIG. 3 is a fractional side elevational view in cross section showing the manifold construction of the preferred embodiment in greater detail; and FIG. 4 is a perspective view showing an alternative manifold construction.

DETAILED DESCRIPTION OF THE PREFERRED EMBODIMENT

Figure 1:
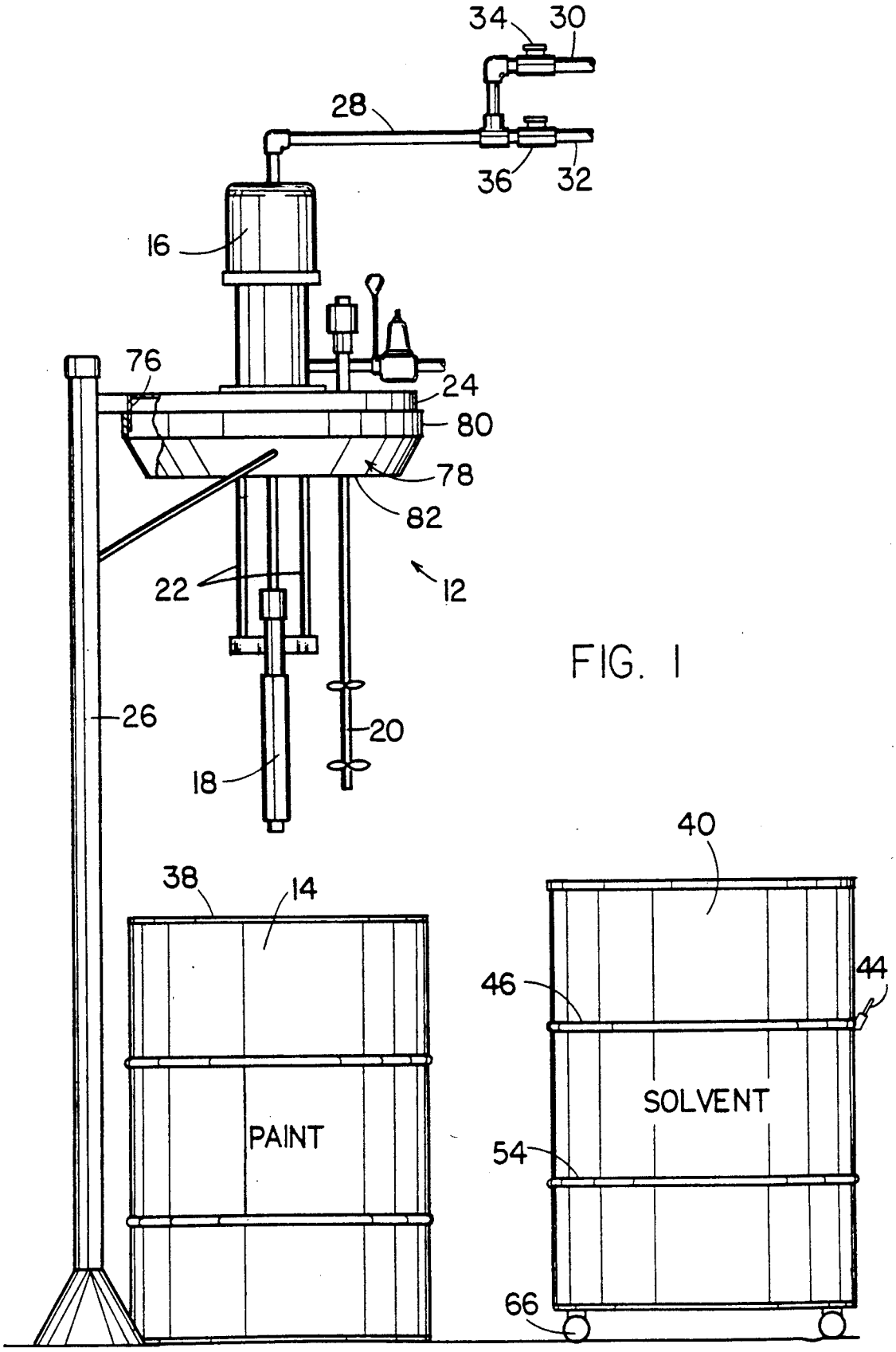
FIG. 1 is a side elevational view showing a step in the use of the present invention.

FIG. 1 shows a paint spraying outfit 12 positioned directly over a drum 14 of paint. The paint spraying outfit 12 is raised and lowered by a lift 26. When in use, portions of the paint spraying outfit extend into the drum 14 of paint. Those portions include a pump and filter assembly 18, an agitator 20, and supporting structure 22. These items 18, 20, 22 are connected to a cover 24. When the paint spraying outfit is in use, the cover 24 rests on the top edge 38 of the drum 14. An air motor 16 mounted on top of the cover 24 powers the pump 18, and the pressurized paint is supplied through the output line 28. The line 28 branches into the lines 30 and 32, and the flow into those lines is controlled, respectively, by the valves 34 and 36.

The apparatus described thus far is well known and widely used for industrial painting. When a first drum of paint has been used, the spraying outfit 12 is lifted from the used drum so that a fresh drum can be substituted and the painting can resume.

At some point, the painting will be terminated. The particular job might be completed, or there might be a need to continue painting, but with a different color. In either event, it is necessary to remove the residual paint from the exterior of the pump 18, the agitator 20, the supporting structure 22, and the underside of the cover 24, as well as from the interior of the pump and lines. In accordance with the preferred embodiment of the present invention, the task of removing the residual paint is accomplished by means of the apparatus of FIGS. 2 and 3; or, in an alternative embodiment, the apparatus of FIGS. 2 and 4.

That apparatus includes a solvent drum 40 containing several gallons of an appropriate solvent. During the paint-removal process, the valve 36 is open and the valve 34 leading to the hand-held spray gun is closed. A hose 42 attached to the line 32 conducts the pumped solvent to a spray manifold within the solvent drum 40.

In the preferred embodiment shown in FIG. 3, the manifold is constructed in a manner which least interferes with the insertion and removal of the paint spraying outfit 12. That form of construction makes use of the swedges 46, 54 which encircle the drum. Bands 48, 56 are welded to the interior of the wall of the drum so that ducts are formed between the bands 48, 56 and the respective swedges 46, 54. A quick-disconnect fitting 44 is installed on the swedge 46, and the hose 42 is connected to it so that the fluid will be supplied to the duct within the swedge 46. A tube 52 carries the solvent from the duct 58 to the duct 60.

Nozzles, of which the nozzle 50 is typical, are installed at several locations on the bands 48, 56, and they serve to direct a spray of solvent radially inwardly towards the pump 18, the agitator 20, the supporting structure 22, and the underside of the cover 24.

A removable stainless steel screen 62 is supported approximately 2 inches above the bottom of the drum 40. A removable pan 64 is located beneath the screen. The screen and the pan are helpful in removing any solid paint residue.

In the preferred embodiment, three swivel casters, of which the caster 66 is typical, are welded to the outside of the solvent drum 40.

The drum 40 is also provided with a grounding stud 84. A grounded lead wire is removably clamped to the grounding stud when the drum is in use. This eliminates the possibility that an electrical spark might cause the solvent or its vapors to explode.

An alternative structure for the manifold is shown in FIG. 4. In that embodiment the manifold is formed of ⅜ inch diameter stainless tubing which is bent to form an upper arc 68 and a lower arc 70. These two arcs 68, 70 are connected by a tube 72. Several nozzles, of which the nozzle 74 is typical, are located along the arcs 68 and 70. The nozzles serve to spray the solvent onto the parts of the paint spraying outfit that extend into the solvent drum 40.

In alternative embodiments the nozzles 50 of FIG. 3 and 74 of FIG. 4 consist of apertures formed, respectively, in the bands 48, 56 of FIG. 3 and in the arcs 68, 70 of FIG. 4.

As supplied from the manufacturer, the cover 24 of the paint spraying outfit 12 sits on the top edge 38 of the drum 40 and includes a rim 76 that surrounds the top of the drum. In use, the solvent had a tendency to leak out of the drum 40 between its upper edge and the cover 24.

To correct this situation, the present inventor has bolted a splash ring 78 to the rim 76 of the cover 24, as shown in FIG. 1. The splash ring 78 includes a band 80 that surrounds the rim 76 of the cover 24, and the band 80 is joined to a downwardly-converging conical portion 82 that conducts droplets of the solvent back into the drum 40.

Thus, there has been described an apparatus for cleaning the residual paint from a spray painting outfit. The apparatus uses the pump of the paint spraying outfit to propel a solvent through the pump and the lines to a manifold that sprays the solvent onto the outside of the pump and related portions of the paint spraying outfit. No separate solvent pump is needed; the paint pump is caused to spray solvent on itself.

As should now be apparent, only a few gallons of solvent are required, and these can be used again and again. The solvent is confined within a drum during the paint-removing operation, and this, along with the small amount of solvent used, reduces contamination of the environment.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. Apparatus for removing residual paint from both the interior portions and the exterior portions of a paint spraying outfit of the type having a cover that fits onto the top of a drum of paint, having portions that extend below the cover into the drum of paint, having a pump, and having an output line connected to the pump, said apparatus comprising in combination:

a solvent drum having a swedge extending circumferentially around it;

a spray manifold including a band coextensive with said swedge and sealed to the inside of said solvent drum on both sides of said swedge to define a duct between said band and said swedge, further including nozzles mounted on said band and communicating with said duct, and further including fitting means connected to said swedge and communicating with said duct; and, means for connecting the output line of the paint spraying outfit to said fitting means of said spray manifold, whereby after the solvent drum has been partially filled with a solvent and the pump has been activated, solvent will be drawn into the pump and pumped through the output line, through said means for connecting, through said spray manifold, and sprayed by said nozzles onto the portions of the paint spraying outfit that extend below the cover, thereby removing residual paint from both the interior portions and the exterior portions of the paint spraying outfit.

2. The apparatus of claim 1 further comprising in combination a splash ring, encircling the cover of the paint spraying outfit and converging downwardly from it to prevent solvent from escaping between said solvent drum and the cover when the apparatus is being used to remove residual paint.

3. The apparatus of claim 1 further comprising a removable pan resting on the bottom of said solvent drum.

4. The apparatus of claim 1 further comprising a removable screen extending horizontally across the space within said solvent drum near the bottom of said solvent drum but spaced from it.

5. Apparatus for removing residual paint from both the interior portions and the exterior portions of a paint spraying outfit of the type having a cover that fits onto the top of a drum of paint, having portions that extend below the cover into the drum of paint, having a pump, and having an output line connected to the pump, said apparatus comprising in combination:

a solvent drum;

a spray manifold within said solvent drum and including nozzles for spraying solvent onto those portions of the paint spraying outfit that extend below the cover;

means for connecting the output line of the paint spraying outfit to said spray manifold; and, a splash ring, encircling the cover of the paint spraying outfit and converging downwardly from it to prevent solvent from escaping between said solvent drum and the cover when the apparatus is being used to remove residual paint.

* * * * *